US011821263B2

(12) United States Patent
Xu et al.

(10) Patent No.: US 11,821,263 B2
(45) Date of Patent: Nov. 21, 2023

(54) REVERSIBLE POLYCRYSTALLINE DIAMOND COMPACT BIT

(71) Applicant: SAUDI ARABIAN OIL COMPANY, Dhahran (SA)

(72) Inventors: Jianhui Xu, Dhahran (SA); Guodong (David) Zhan, Dhahran (SA); Timothy Eric Moellendick, Dhahran (SA); Amjad O. Shaarawi, Al Khobar (SA); Abdulwahab S. Al-Johar, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 383 days.

(21) Appl. No.: 17/072,464

(22) Filed: Oct. 16, 2020

(65) Prior Publication Data

US 2022/0120138 A1 Apr. 21, 2022

(51) Int. Cl.

| | |
|---|---|
| ***E21B 10/28*** | (2006.01) |
| ***E21B 10/43*** | (2006.01) |
| ***E21B 4/02*** | (2006.01) |
| ***E21B 4/04*** | (2006.01) |
| ***E21B 4/16*** | (2006.01) |
| ***E21B 10/00*** | (2006.01) |
| ***E21B 10/567*** | (2006.01) |
| ***E21B 34/16*** | (2006.01) |

(52) U.S. Cl.

CPC ..... *E21B 10/003* (2013.01); *E21B 4/02* (2013.01); *E21B 4/04* (2013.01); *E21B 4/16* (2013.01); *E21B 10/43* (2013.01); *E21B 10/567* (2013.01); *E21B 34/16* (2013.01); *E21B 2200/06* (2020.05)

(58) Field of Classification Search

CPC . E21B 10/28; E21B 10/43; E21B 4/02; E21B 4/04; E21B 4/16

See application file for complete search history.

(56) References Cited

U.S. PATENT DOCUMENTS

| | | | | |
|---|---|---|---|---|
| 9,816,320 | B1 * | 11/2017 | Herrick | H02G 1/06 |
| 2002/0104688 | A1 * | 8/2002 | Hoffmaster | E21B 10/43 175/385 |
| 2006/0162966 | A1 | 7/2006 | Richert et al. | |
| 2016/0032655 | A1 | 2/2016 | Boehm et al. | |
| 2017/0081923 | A1 | 3/2017 | Nakamura et al. | |

(Continued)

OTHER PUBLICATIONS

International Search Report and Written Opinion of the International Searching Authority issued in corresponding International Application No. PCT/US2021/055187, dated Jan. 18, 2022 (12 pages).

*Primary Examiner* — Cathleen R Hutchins

(74) *Attorney, Agent, or Firm* — Osha Bergman Watanabe & Burton LLP

(57) ABSTRACT

A reversible polycrystalline diamond compact (PDC) bit. The reversible PDC bit includes at least one blade, at least one front cutter disposed on a first side of the at least one blade, and at least one rear cutter disposed on a second side of the at least one blade, wherein the first side is opposite to the second side along a circumferential direction of the reversible PDC bit, wherein rotating the reversible PDC bit in a clockwise direction engages the at least one front cutter to cut into a subterranean formation, and wherein rotating the reversible PDC bit in a counter-clockwise direction engages the at least one rear cutter to cut into the subterranean formation.

7 Claims, 6 Drawing Sheets

(56) References Cited

U.S. PATENT DOCUMENTS

| | | | | |
|---|---|---|---|---|
| 2018/0328114 | A1 | 11/2018 | Chen | |
| 2019/0145186 | A1 * | 5/2019 | Carpenter | E21B 4/16<br>175/57 |
| 2020/0011137 | A1 | 1/2020 | Maurstad | |

* cited by examiner

REVERSIBLE POLYCRYSTALLINE DIAMOND COMPACT BIT

BACKGROUND

A polycrystalline diamond compact (PDC) bit is a drill bit that uses synthetic diamond disks, called "cutters," to shear through rock with an ongoing scraping motion. The cutter has clusters of diamond grains that are aggregated into larger masses of crystals with random orientations. The PDC bit is used in drilling boreholes into a subterranean formation.

PDC bits have been widely used in drilling various formations from soft to hard, from brittle to tough, in shallow to deep wells. The PDC cutters are the main cutting elements to shear off the formation with the clockwise rotation of the bottom hole assembly (BHA) energized by the downhole motor and/or top drive. The PDC cutters are brazed to the bit body on the predominantly right (front) sides of the blades. Some other PDC cutters are brazed on the tops and sides of the blades to provide several different functions including the controlled depth of cut, secondary cutting and protection of the blade or the primary cutters. There is, however, no PDC cutter on the left (back) sides of the blades due to the traditionally right (clockwise) turn of the drill string during drilling. When it is determined to change the bit due to the low rate of penetration (ROP) or predicted formation change, the whole bottom hole assembly (BHA) needs to be pulled out of the hole, and this requires a time consuming tripping process to pull out the entire BHA from the wellbore. For example, when the drill bit is at about 12000 ft total depth, approximately 2 days are required for the tripping to change the drill bit and the BHA.

SUMMARY

In general, in one aspect, the invention relates to a reversible polycrystalline diamond compact (PDC) bit. The reversible PDC bit includes at least one blade, at least one front cutter disposed on a first side of the at least one blade, and at least one rear cutter disposed on a second side of the at least one blade, wherein the first side is opposite to the second side along a circumferential direction of the reversible PDC bit, wherein rotating the reversible PDC bit in a clockwise direction engages the at least one front cutter to cut into a subterranean formation, and wherein rotating the reversible PDC bit in a counter-clockwise direction engages the at least one rear cutter to cut into the subterranean formation.

In general, in one aspect, the invention relates to a bottom hole assembly (BHA). The BHA includes (i) a reversible polycrystalline diamond compact (PDC) bit having at least one blade, at least one front cutter disposed on a first side of the at least one blade, and at least one rear cutter disposed on a second side of the at least one blade, wherein the first side is opposite to the second side along a circumferential direction of the reversible PDC bit, and (ii) a downhole motor assembly coupled to the reversible PDC bit and configured to rotate the reversible PDC bit, and selectively reverse a rotation direction of the reversible PDC bit, wherein rotating the reversible PDC bit by the downhole motor assembly in a clockwise direction engages the at least one front cutter to cut into a subterranean formation, and wherein rotating the reversible PDC bit by the downhole motor assembly in a counter-clockwise direction engages the at least one rear cutter to cut into the subterranean formation.

In general, in one aspect, the invention relates to a method to drill a wellbore into a subterranean formation. The method includes installing a reversible polycrystalline diamond compact (PDC) bit in a drill string of the wellbore, the reversible PDC bit including at least one blade, at least one front cutter disposed on a first side of the at least one blade, and at least one rear cutter disposed on a second side of the at least one blade, wherein the first side is opposite to the second side along a circumferential direction of the reversible PDC bit, rotating the reversible PDC bit in a clockwise direction to engage the at least one front cutter to cut into the subterranean formation, and rotating the reversible PDC bit in a counter-clockwise direction to engage the at least one rear cutter to cut into the subterranean formation.

Other aspects and advantages will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments of this disclosure provide a reversible polycrystalline diamond compact (PDC) bit and a method for performing a drilling operation using the reversible PDC drill bit. In one or more embodiments of the invention, the reversible PDC bit includes PDC cutters on both right (front) sides and left (back) sides of the blades of the PDC bit. With both sides of the blades carrying PDC cutters, the PDC bit is configured to rotate in both clockwise or counter-clockwise direction. For example, the reversible PDC bit may change the rotation direction after the front PDC cutters lose aggressiveness (i.e., become dull or worn out) or when encountering a formation rock change during drilling.

Figure 1:
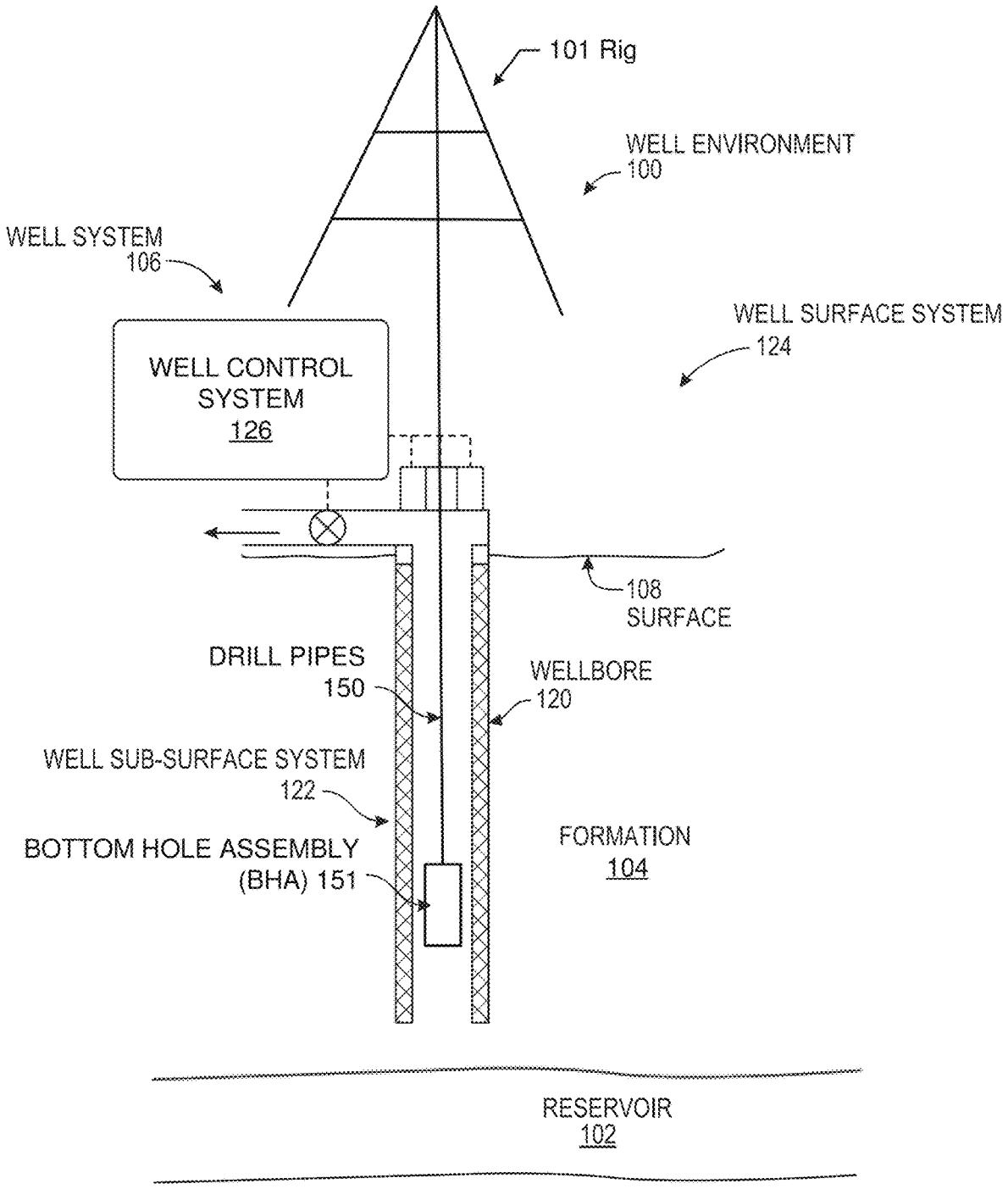
FIGS. 1 and 2 show systems in accordance with one or more embodiments.

FIG. 1 shows a schematic diagram in accordance with one or more embodiments. As shown in FIG. 1, a well environment (100) includes a subterranean formation ("formation")

(104) and a well system (106). The formation (104) may include a porous or fractured rock formation that resides underground, beneath the earth's surface ("surface") (108). The formation (104) may include different layers of rock having varying characteristics, such as varying degrees of permeability, porosity, capillary pressure, and resistivity. In the case of the well system (106) being a hydrocarbon well, the formation (104) may include a hydrocarbon-bearing reservoir (102). In the case of the well system (106) being operated as a production well, the well system (106) may facilitate the extraction of hydrocarbons (or "production") from the reservoir (102).

In some embodiments disclosed herein, the well system (106) includes a rig (101), a wellbore (120), a well subsurface system (122), a well surface system (124), and a well control system ("control system") (126). The well control system (126) may control various operations of the well system (106), such as well production operations, well drilling operation, well completion operations, well maintenance operations, and reservoir monitoring, assessment and development operations. In some embodiments, the well control system (126) includes a computer system.

The rig (101) is the machine used to drill a borehole to form the wellbore (120). Major components of the rig (101) include the drilling fluid tanks, the drilling fluid pumps (e.g., rig mixing pumps), the derrick or mast, the draw works, the rotary table or top drive, the drill string, the power generation equipment and auxiliary equipment. Drilling fluid, also referred to as "drilling mud" or simply "mud," is used to facilitate drilling boreholes into the earth, such as drilling oil and natural gas wells. The main functions of drilling fluids include providing hydrostatic pressure to prevent formation fluids from entering into the borehole, keeping the drill bit cool and clean during drilling, carrying out drill cuttings, and suspending the drill cuttings while drilling is paused and when the drilling assembly is brought in and out of the borehole.

The wellbore (120) includes a bored hole (i.e., borehole) that extends from the surface (108) towards a target zone of the formation (104), such as the reservoir (102). An upper end of the wellbore (120), terminating at or near the surface (108), may be referred to as the "up-hole" end of the wellbore (120), and a lower end of the wellbore, terminating in the formation (104), may be referred to as the "downhole" end of the wellbore (120). The wellbore (120) may facilitate the circulation of drilling fluids during drilling operations for the wellbore (120) to extend towards the target zone of the formation (104) (e.g., the reservoir (102)), facilitate the flow of hydrocarbon production (e.g., oil and gas) from the reservoir (102) to the surface (108) during production operations, facilitate the injection of substances (e.g., water) into the hydrocarbon-bearing formation (104) or the reservoir (102) during injection operations, or facilitate the communication of monitoring devices (e.g., logging tools) lowered into the formation (104) or the reservoir (102) during monitoring operations (e.g., during in situ logging operations).

In some embodiments, the well system (106) is provided with a bottom hole assembly (BHA) (151) attached to drill pipes (150) to suspend into the wellbore (120) for performing the well drilling operation. The bottom hole assembly (BHA) is the lowest part of a drill string and includes the drill bit, drill collar, stabilizer, mud motor, etc. A mud motor is a drilling motor that uses hydraulic horsepower of the drilling fluid to drive the drill bit during the drilling operation. Details of the BHA (151) are described in reference to FIG. 2 below.

Figure 2:
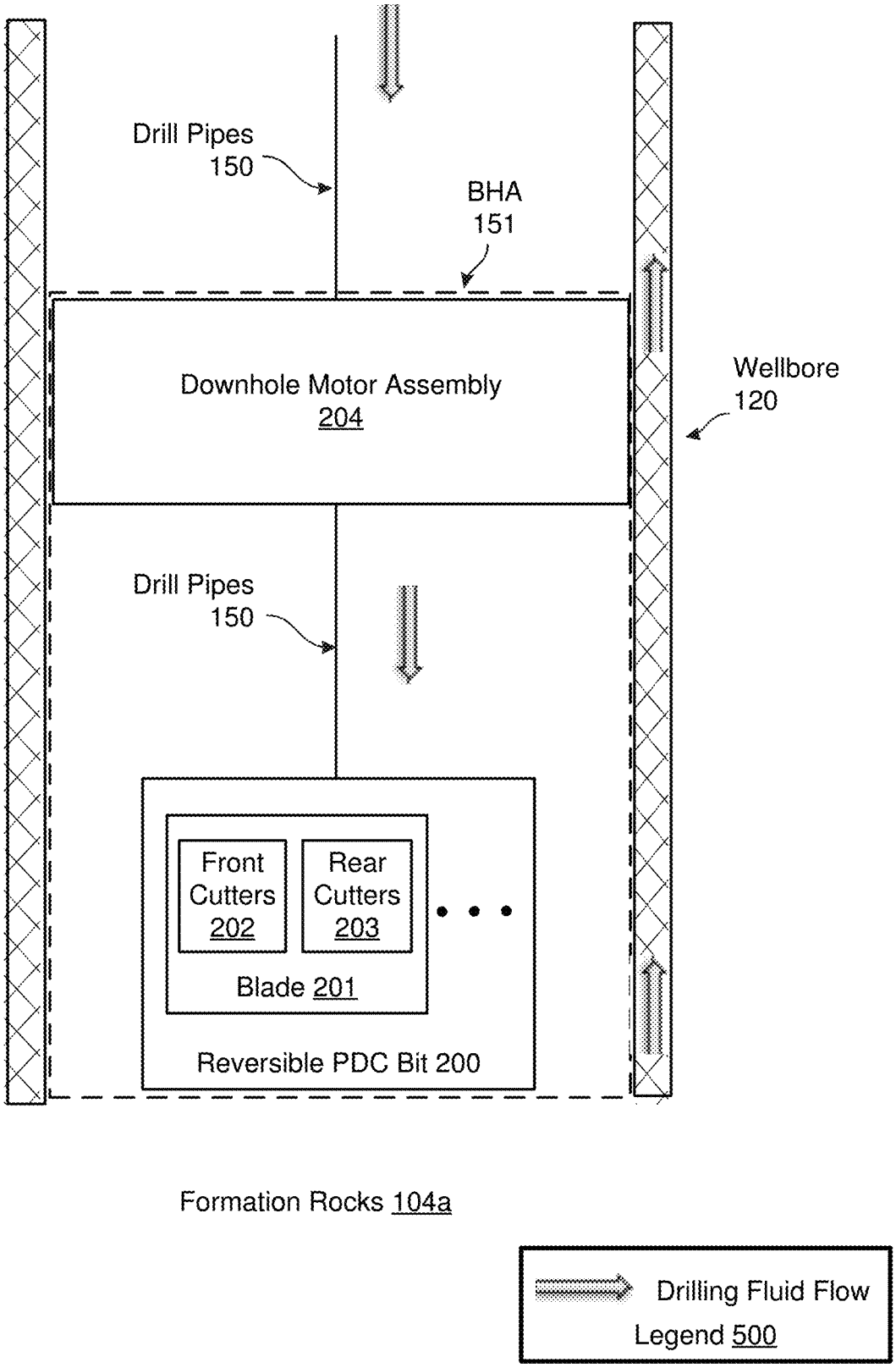

Turning to FIG. 2, FIG. 2 illustrates further details of the BHA (151) suspended in the wellbore (120) in accordance with one or more embodiments disclosed herein. In one or more embodiments, one or more of the modules and/or elements shown in FIG. 2 may be omitted, repeated, combined and/or substituted. Accordingly, embodiments disclosed herein should not be considered limited to the specific arrangements of modules and/or elements shown in FIG. 2.

Figure 4A:
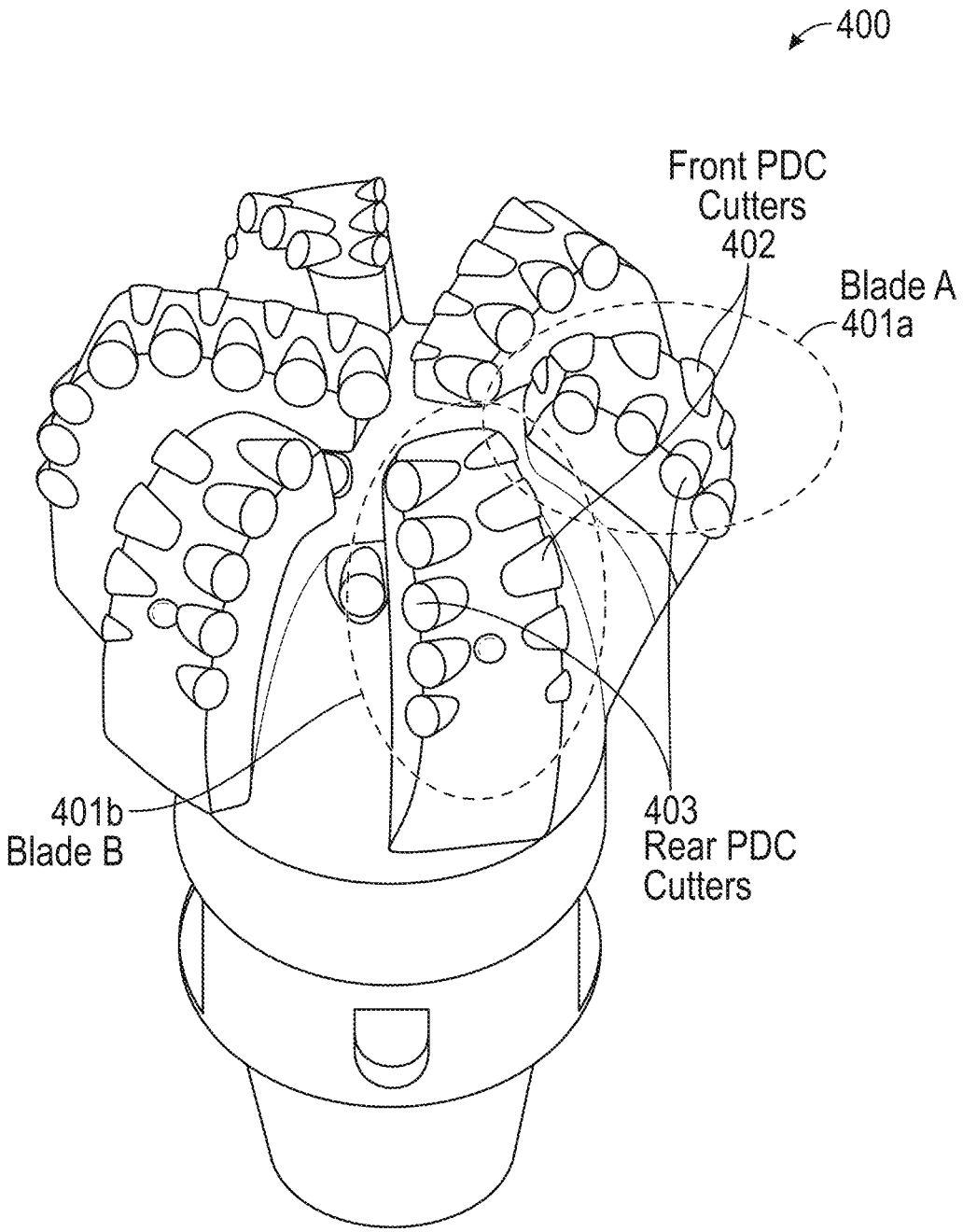
FIGS. 4A, 4B, 4C, 4D, and 4E show examples in accordance with one or more embodiments.

As shown in FIG. 2, the BHA (151) includes a reversible polycrystalline diamond compact (PDC) bit (200) connected to a downhole motor assembly (204) via a drill pipe, such as a section of the drill pipes (150). In some embodiments, the reversible PDC bit (200) is driven by a surface motor in which case the downhole motor assembly (204) may be omitted. In one or more embodiments of the invention, the reversible PDC bit (200) includes one or more blades such as the blade (201). In contrast to a conventional PDC bit that only carries the PDC cutters on one side of each blade, the blade (201) of the reversible PDC bit (200) are brazed with PDC cutters on both sides. In particular, at least one front cutter (i.e., front cutters (202) is disposed on a first side of the blade (201) while at least one rear cutter (i.e., rear cutters (203) is disposed on a second side of the blade (201). The first side is opposite to the second side along a circumferential direction of the reversible PDC bit (200). An example of the PDC cutters brazed onto two sides of the blade along the circumferential direction of the reversible PDC bit is shown in FIG. 4A below.

In one or more embodiments, the downhole motor assembly (204) is configured to rotate the reversible PDC bit (200) and selectively reverse a rotation direction of the reversible PDC bit (200). For example, rotating the reversible PDC bit (200) by the downhole motor assembly (204) in a clockwise direction engages the front cutters (202) to cut into the formation rocks (104*a*) while rotating the reversible PDC bit (200) by the downhole motor assembly (204) in a counterclockwise direction engages the rear cutters (203) to cut into the formation rocks (104*a*). In one or more embodiments, the front cutters (202) and the rear cutters (203) have the same material grades and the same geometries. In such embodiments, the reversible PDC bit (200) has twice the service life of a conventional drill bit having only one set of cutters. In one or more embodiments, the front cutters (202) and the rear cutters (203) have different material grades and/or different geometries. In such embodiments, the material grade and/or geometry of the front cutters (202) may be designed or otherwise selected to cut one type of formation rocks (104*a*), while the material grade and/or geometry of the rear cutters (203) are designed or otherwise selected to cut a different type of formation rocks (104*a*). For example, when different types (e.g., soft versus hard, brittle versus tough, shallow versus deep, etc.) of formation rocks (104*a*) are encountered during the drilling operation, the need for tripping is reduced by simply reversing the direction of rotation of the PDC bit and switching between the front cutters (202) and the rear cutters (203).

Those skilled in the art will appreciate that configurations of the front and rear cutters may be different than that described above, without departing from the scope of this disclosure. For example, the material grade and/or geometries of the front and rear cutters may be the same. Alternatively, the material grade of the front cutters and rear cutters may be the same, while the geometries are different. In yet other embodiments, the material grade of the front and rear cutters may be different, while the geometries are the same.

Example configurations of the downhole motor assembly (204) for selectively reversing the rotation direction of the reversible PDC bit (200) are described in reference to FIGS. 4B-4E below.

Figure 3:
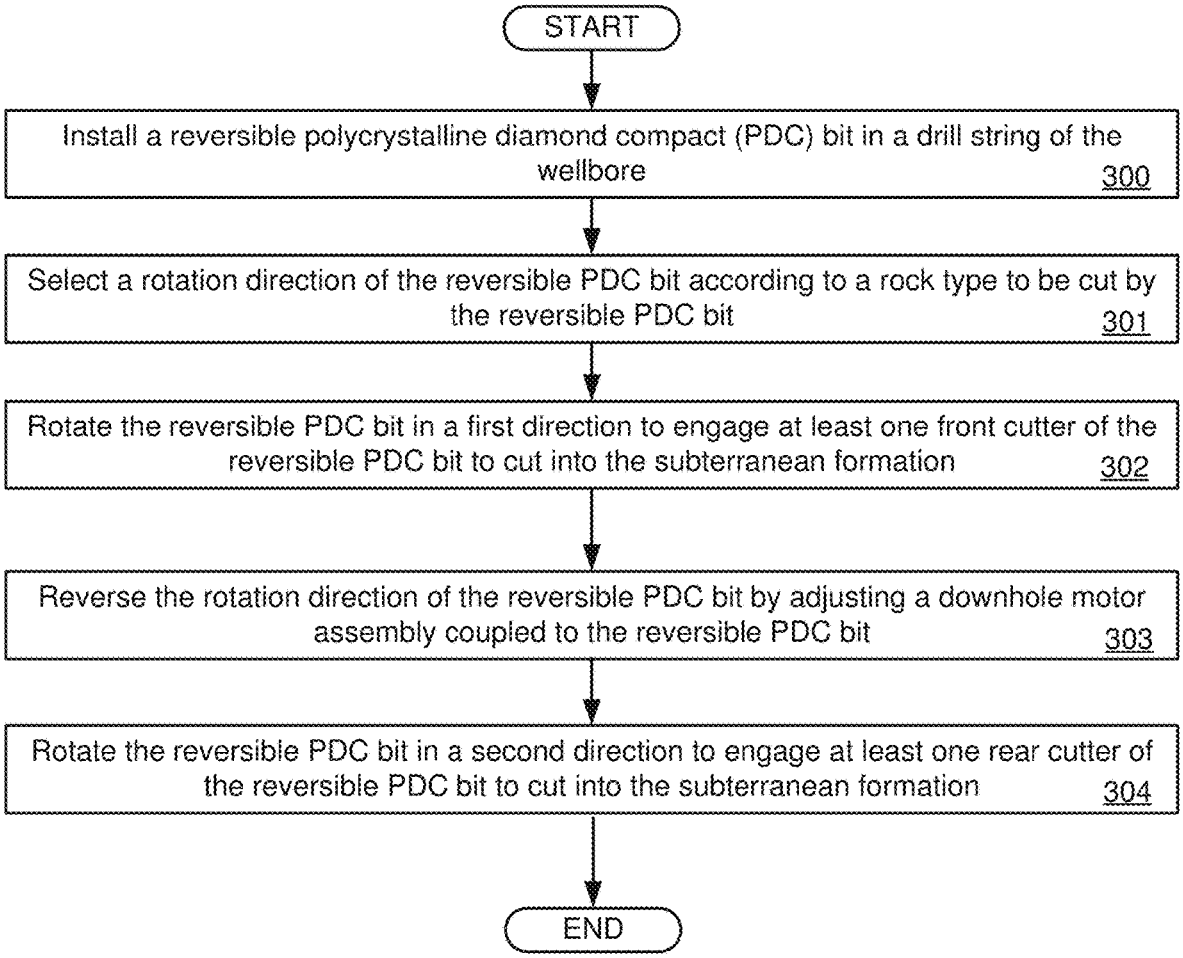
FIG. 3 shows a flowchart in accordance with one or more embodiments.

Turning to FIG. 3, FIG. 3 shows a process flowchart in accordance with one or more embodiments. One or more blocks in FIG. 3 may be performed using one or more components as described in FIGS. 1 and 2. While the various blocks in FIG. 3 are presented and described sequentially, one of ordinary skill in the art will appreciate that some or all of the blocks may be executed in a different order, may be combined or omitted, and some or all of the blocks may be executed in parallel and/or iteratively. Furthermore, the blocks may be performed actively or passively.

Initially in Block 300, a reversible polycrystalline diamond compact (PDC) bit is installed in a drill string of the wellbore. In one or more embodiments of the invention, the reversible PDC bit is installed in the bottom hole assembly (BHA) and includes at least one blade, at least one front cutter disposed on a first side of the at least one blade, and at least one rear cutter disposed on a second side of the at least one blade. In particular, the first side is opposite to the second side along a circumferential direction of the reversible PDC bit.

In Block 301, a rotation direction of the reversible PDC bit is selected, from the clockwise direction and the counter-clockwise direction, according to a rock/formation type to be cut by the reversible PDC bit. The front cutter(s) and the rear cutter(s) have different material types or different geometries that are selected according to different rock types in the subterranean formation.

In Block 302, the reversible PDC bit is rotated in a selected direction from Block 301 to engage the corresponding cutter to cut into the subterranean formation. For example, if a clockwise direction is selected in Block 301, then the front cutter(s) may be engaged to cut the subterranean formation. Alternatively, if a counter-clockwise direction is selected in Block 301, the rear cutter(s) may be engaged to cut into the subterranean formation. In other embodiments, the clockwise direction may correspond to engagement of the rear cutter(s) and the counter-clockwise rotation direction may correspond to engagement of the front cutter(s). In one or more embodiments, the reversible PDC bit is driven by a downhole motor assembly to rotate in the selected direction.

In Block 303, the rotation direction of the reversible PDC bit is reversed, between the clockwise direction and the counter-clockwise direction or vice versa depending on the selected direction that was initially made in Block 301, by adjusting the downhole motor assembly coupled to the reversible PDC bit. In one or more embodiments, Block 303 may be triggered by a change in the subterranean formation, for which the material grade and/or geometry of the opposite side cutter(s) would be more efficient in cutting the subterranean formation. In one or more embodiments, the determination to reverse the rotation direction of the reversible PDC bit may be triggered by wearing of the cutters on the side of the reversible PDC bit that has been engaged thus far in the drilling process. For example, the front cutter(s) lose aggressiveness or the sharpness of the cutters may wear. In this case, the formation may continue to be drilled by reversing the direction of rotation of the reversible PDC bit, thereby avoiding removal of the drill string completely to change out the PDC bit.

Continuing with Block 303, in one or more embodiments, the downhole motor assembly includes a clockwise mud motor, a counter-clockwise mud motor, and a sliding sleeve system. In such embodiments, reversing the rotation direction of the reversible PDC bit includes adjusting the sliding sleeve system to direct a drilling fluid flow to selectively bypass one of the clockwise mud motor and the counter-clockwise mud motor to change the rotation direction of the reversible PDC bit, In one or more embodiments, the downhole motor assembly includes a single mud motor and a sliding sleeve system. In such embodiments, reversing the rotation direction of the reversible PDC bit includes adjusting the sliding sleeve system to direct a drilling fluid to selectively flow through the mud motor in one of two opposite directions to change the rotation direction of the reversible PDC bit.

In one or more embodiments, the downhole motor assembly includes a clutch system, a clockwise mud motor, and a counter-clockwise mud motor. The clutch system includes an actuator for controlling an engagement disk, a clockwise disk coupled to the clockwise mud motor, and a counter-clockwise disk coupled to the counter-clockwise mud motor. In such embodiments, reversing the rotation direction of the reversible PDC bit includes adjusting the actuator to selectively couple the engagement disk to one of the clockwise disk and the counter-clockwise disk to change the rotation direction of the reversible PDC bit, In one or more embodiments, the downhole motor assembly includes a downhole DC electric motor powered by a surface power source or a downhole generator system. In such embodiments, reversing the rotation direction of the reversible PDC bit includes adjusting a polarity of electricity provide to the downhole DC electric motor to change the rotation direction of the reversible PDC bit.

In Block 304, the reversible PDC bit is rotated in the counter-clockwise direction to engage the opposite side cutters (i.e., rear or front depending on the selection initially made in Block 301) to cut into the subterranean formation. Similar to rotating in the first selected direction (e.g., clockwise direction), the reversible PDC bit is driven by the downhole motor assembly to rotate in the opposite direction (e.g., counter-clockwise direction).

As a result of the process shown in FIG. 3, the drilling operation using the reversible PDC bit is lengthened without interruption for tripping of the PDC bit. Those skilled in the art will appreciate that the above-mentioned rotation direction changes may be reciprocal and that the process of FIG. 3 may be repeated more than once. That is, the rotation directional changes may be performed as many times as the operator thinks necessarily. For example, rather than wearing one side of the blade cutters down completely before reversing the rotation direction of the reversible PDC bit, the operator may choose to wear both sides evenly by more frequent rotation direction changes. Alternatively, if various different types of formations are encountered, the rotation direction may be changed more frequently.

FIGS. 4A-4E show examples in accordance with one or more embodiments. The examples shown in FIGS. 4A-4E are based on the system and method described in reference to FIGS. 1-3 above. In particular, FIG. 4A shows an example of the reversible PDC bit, and FIGS. 4B-4E show examples of the downhole motor assembly for the reversible PDC bit. While the reversible PDC bit is not always explicitly shown throughout FIGS. 4B-4E, it is understood that the reversible PDC bit is coupled to the downhole motor assembly via a drill pipe as depicted in FIG. 2 above.

As shown in FIG. 4A, the reversible PDC bit (400) includes 6 blades, such as the blade A (401*a*) and blade B (401*b*) that are examples of the blade (201) depicted in FIG. 2 above. The front PDC cutters (402) are brazed to the bit body on the predominantly right (front) sides of the blade A (401*a*). In addition, the rear PDC cutters (403) are brazed to the bit body on the predominantly left (back) sides of the blade A (401*a*). The front PDC cutters (402) and rear PDC cutters (403) are referred to as the primary cutters and are examples of the front cutters (202) and rear cutters (203), respectively, depicted in FIG. 2 above. Further, additional PDC cutters are brazed on the tops and sides of the blades to provide different functions including the controlled depth of cut, secondary cutting and protection of the blade or the primary cutters.

Figure 4B:
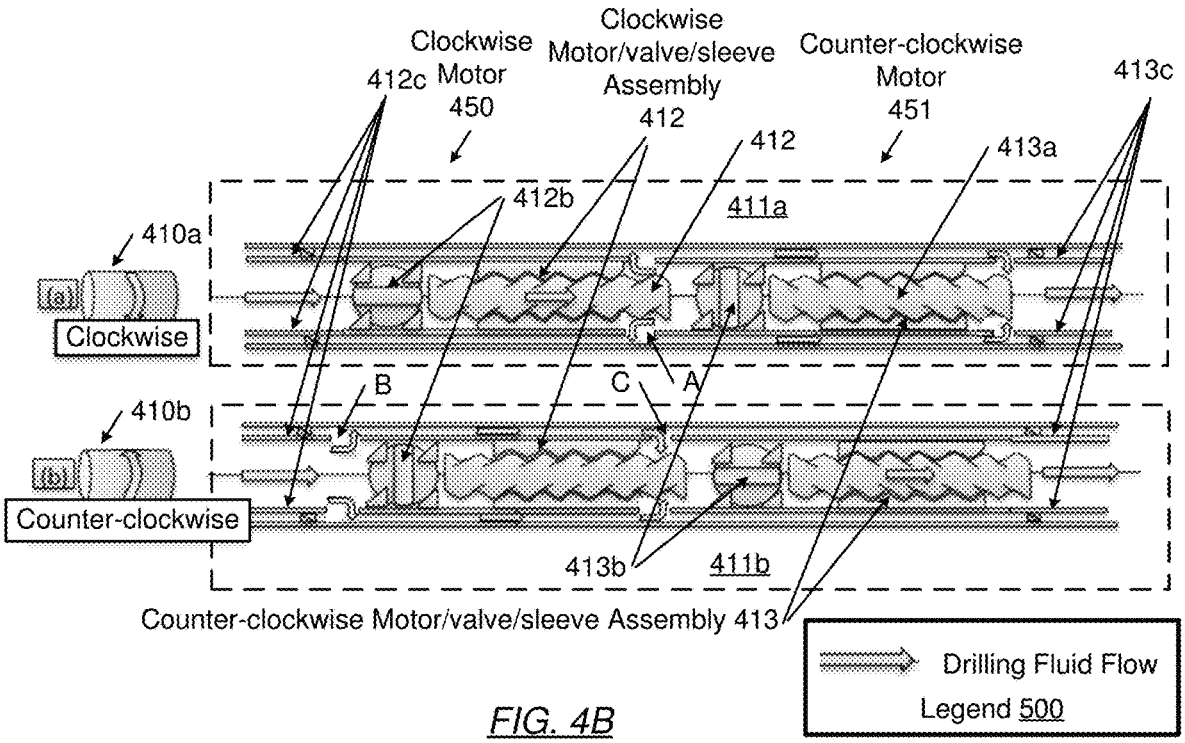

FIG. 4B shows a longitudinal cross section view of an example downhole motor assembly based on two downhole mud motors that alternatively rotate the reversible PDC bit in opposite directions. In this example, a sliding sleeve system is used to detour the drilling fluid flow direction (depicted as arrows according to the legend (500)) from a clockwise motor/valve/sleeve assembly (412) of the first mud motor (i.e., clockwise motor (450)) to a counter-clockwise motor/valve/sleeve assembly (413) of the second mud motor (i.e., counter-clockwise motor (451)), and vice versa, to change the rotation direction of the reversible PDC bit. In particular, the clockwise motor (450) includes the clockwise motor/valve/sleeve assembly (412) (i.e., rotor (412*a*) and valve (412*b*) and a sliding sleeve (412*c*)) that collectively cause the reversible PDC bit to rotate in the clockwise direction (410*a*). The counter-clockwise motor (451) includes the counter-clockwise motor/valve/sleeve assembly (413) (i.e., rotor (413*a*) and valve (413*b*) and a sliding sleeve (413*c*)) that collectively cause the reversible PDC bit to rotate in the counter-clockwise direction (401*b*).

As shown in the top half of FIG. 4B, during regular drilling, the downhole motor assembly is set up in a clockwise configuration (411*a*) where the valve (412*b*) is in the open flow position to allow the drilling fluid flow through the rotor (412*a*) while the valve (413*b*) is in the blocked flow position to force the drilling fluid flow into an annulus of the downhole motor assembly thus bypassing the counter-clockwise motor/valve/sleeve assembly (413). The hydraulic power of the drilling fluid flowing through the clockwise stator/rotor assembly (412) drives the rotor (412*a*) of the clockwise motor (450) to rotate the reversible PDC bit in the clockwise direction (410*a*). The counter-clockwise motor (451) is stationary as the counter-clockwise motor/valve/sleeve assembly (413) does not receive any hydraulic power of the drilling fluid flow to drive the reversible PDC bit. In particular, the user sets up (e.g., by sliding) the sliding sleeves (412*c*) and (413*c*) to detour the drilling fluid flow, at position "A" upstream to the counter-clockwise stator/rotor assembly (413), into the annulus of the downhole motor assembly to bypass the counter-clockwise motor/valve/sleeve assembly (413). In the clockwise configuration (411*a*), the downhole motor assembly drives the drill pipe to rotate the reversible PDC bit in the clockwise direction (410*a*) where the front PDC cutters (402) are used to cut the formation rocks.

As shown in the bottom half of FIG. 4B, when a user determines to change the drill bit rotation direction, the user sets up the downhole motor assembly in a counter-clockwise configuration (411*b*) where the valve (412*b*) is in the blocked flow position to direct the drilling fluid flow into the annulus of the downhole motor assembly bypassing the clockwise motor/valve/sleeve assembly (412) while the valve (413*b*) is in the open flow position to allow the drilling fluid flow through the counter-clockwise motor/valve/sleeve assembly (413). In particular, the user sets up (e.g., by sliding) the sliding sleeve (412*c*) to detour the drilling fluid flow, at position "B" upstream to the clockwise motor/valve/sleeve assembly (412), into the annulus of the downhole motor assembly to bypass the clockwise motor/valve/sleeve assembly (412). At the same time, the user sets up (e.g., by sliding) the sliding sleeve (413*c*) to return the drilling fluid flow, at position "C" upstream to the counter-clockwise motor/valve/sleeve assembly (413), from the annulus of the downhole motor assembly into the counter-clockwise motor/valve/sleeve assembly (413). In the counter-clockwise configuration (411*b*), the downhole motor assembly drives the drill pipe to rotate the reversible PDC bit in the counter-clockwise direction (410*b*) where the rear PDC cutters (403) are used to cut the formation rocks.

In the example described above, the on and off controls of the valves can be achieved by dropping objects from the surface such as balls or darts. These objects can be made of dissolvable or non-dissolvable materials. When these objects are dropped and landed on the landing seats of the valves, the differential pressures are changed across the valves, triggering the valves to rotate in preset steps so as to close/open the valves correspondingly. When the on and off controls of the valves are realized, the differential pressures can push the sliding sleeves to move. In addition, a shear pin system with different shear values can be configured to control the pressure windows of each of the sliding sleeves. In the example described above, although the clockwise motor (450) is upstream to the counter-clockwise motor (451), the clockwise motor (450) may also be disposed downstream from the counter-clockwise motor (451) in other dual mud motor and sliding sleeves arrangements.

Figure 4C:
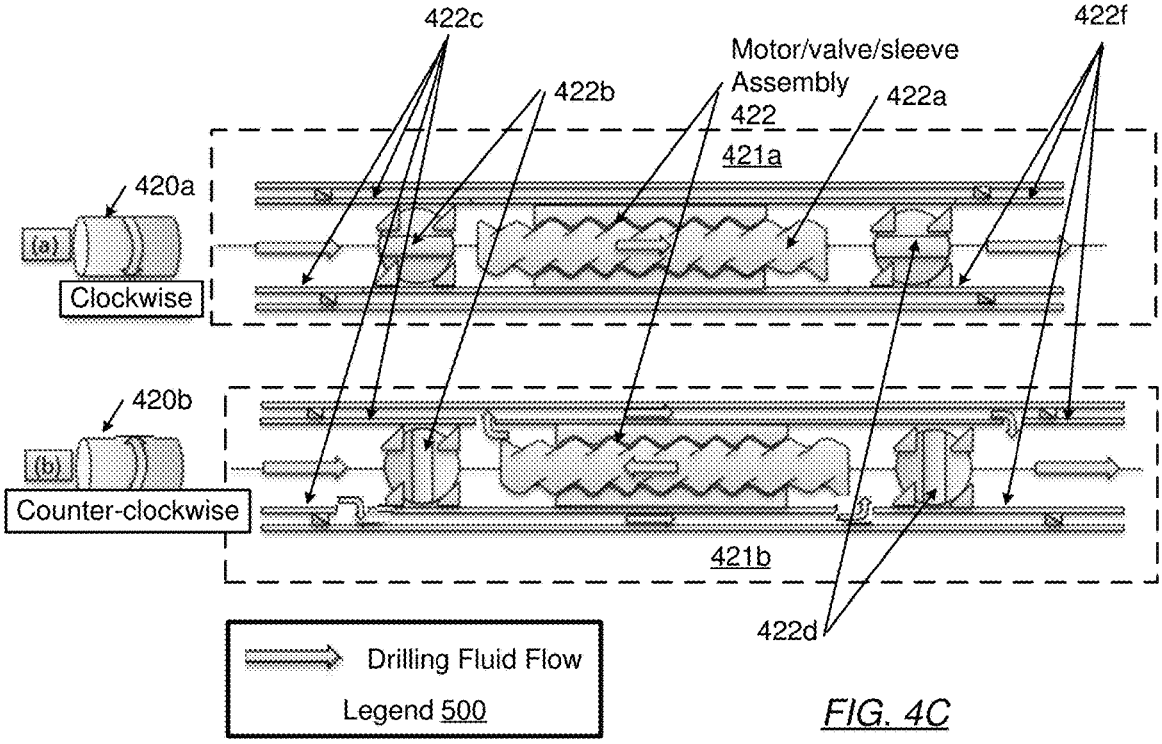

FIG. 4C shows a longitudinal cross section view of an example downhole motor assembly based on one downhole mud motor with by-pass through a sliding sleeve. In this example, a sliding sleeve system is used to direct the drilling fluid flow (depicted as arrows according to the legend (500)) between two opposite directions to change the rotation direction of the reversible PDC bit. In particular, the motor/valve/sleeve assembly (422) of the mud motor includes a rotor (422*a*), a first valve (422*b*), a first sliding sleeve (422*c*), a second valve (422*d*), and a second sliding sleeve (422*f*).

As shown in the top half of FIG. 4C, during regular drilling in the clockwise configuration (421*a*), the drilling fluid flows through the motor/valve/sleeve assembly (422) of the mud motor to rotate the reversible PDC bit in the clockwise direction (420*a*). Specifically, the drill pipe under the downhole motor assembly rotates the reversible PDC bit in the clockwise direction (420*a*) using the front PDC cutters (402) to cut the formation rocks. When it is time to change the rotation direction, the operator sets up the first valve (422*b*) and the second valve (422*d*) in the counter-clockwise configuration (421*b*) to block the regular flow of drilling fluid upstream and downstream to the motor/valve/sleeve assembly (422). In addition, the user slides the first sliding sleeve (422*c*) and the second sliding sleeve (4220 to detour the drilling fluid into the annulus of the downhole motor assembly such that the flow direction of the drilling fluid through the motor/valve/sleeve assembly (422) is reversed from the clockwise configuration (421*a*). As a result, the drill pipe under the downhole motor assembly rotates the reversible PDC bit in the counter-clockwise direction using the rear PDC cutters (403) to cut the formation rocks.

In the example described above, the on and off controls of the valves can be achieved by dropping objects from the surface such as balls or darts. These objects can be made of dissolvable or non-dissolvable materials. When these objects are dropped and landed on the landing seats of the valves, the differential pressures are changed across the valves, triggering the valves to rotate in preset steps so as to close/open the valves correspondingly. When the on and off controls of the valves are realized, the differential pressures can push the sliding sleeves to move. In addition, a shear pin system with different shear values can be condifured to control the pressure windows of each of the sliding sleeves. Further, in the example described above, although the drilling fluid flows through the motor/valve/sleeve assembly (422) in the clockwise configuration (421*a*), the drilling fluid may flow through the motor/valve/sleeve assembly (422) in the counter-clockwise configuration (421*b*) in other single mud motor and sliding sleeve arrangements.

Figure 4D:
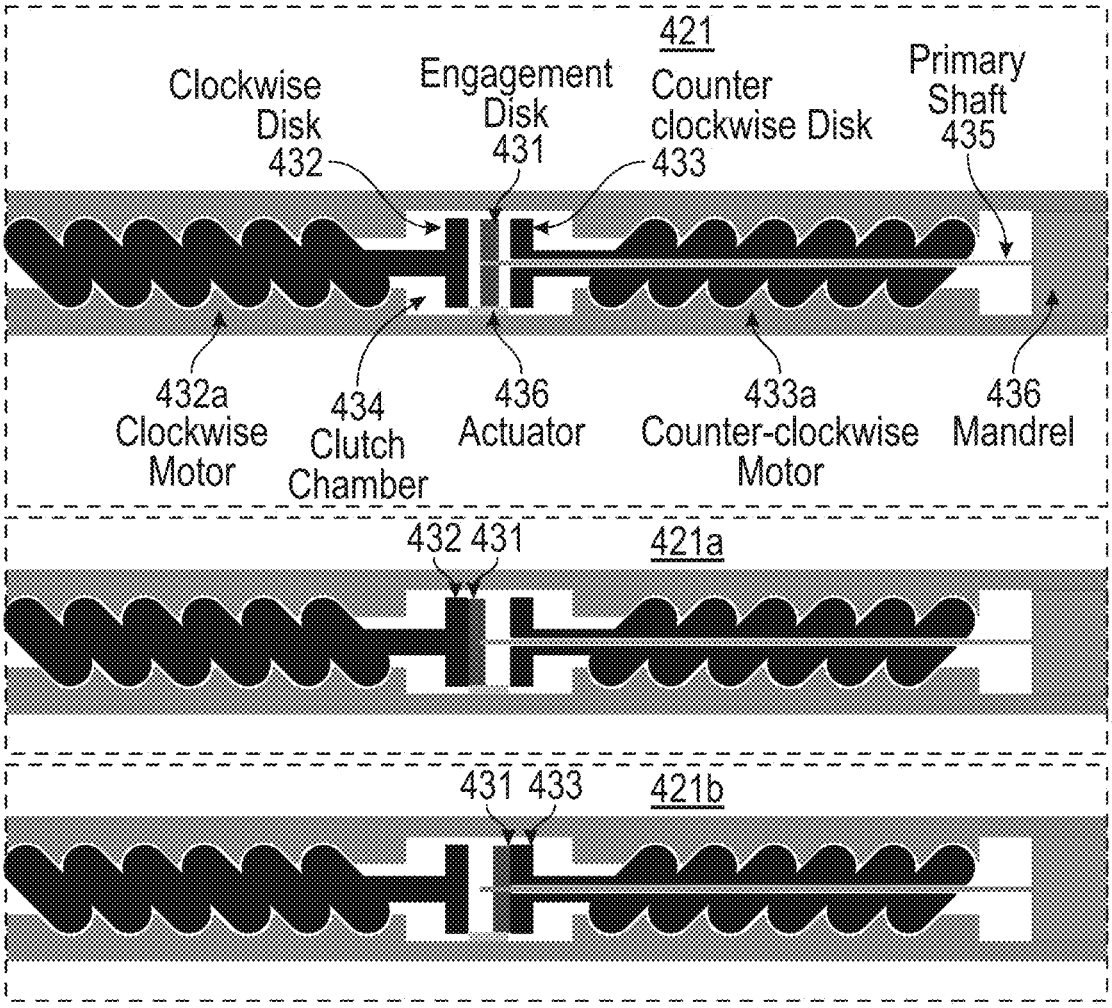

FIG. 4D shows a longitudinal cross section view of an example downhole motor assembly based on two downhole mud motors with a clutch. As shown in FIG. 4D, the downhole motor assembly includes a clockwise motor (432*a*) and a counter-clockwise motor (433*a*) that are coupled to the clockwise disk (432) and the counter-clockwise disk (433), respectively, of the clutch. An engagement disk (431) of the clutch is coupled to a mandrel (436) via a primary shaft (435) for driving a reversible PDC bit.

In a neutral configuration (421), the engagement disk (431) is controlled by the actuator (436) to be separate from both the clockwise disk (432) and the counter-clockwise disk (433) of the clutch. Accordingly, the reversible PDC bit remains stationary without rotation. In one or more embodiments, the engagement between the clutch actuator and either of the clockwise disk (431) or counter-clockwise disk (433) may be realized by electromagnetic force between them which are connected downhole through either drill string or additional electric cable. The operator at the surface can remotely control the electric force and polarity based on the timing and option of the engagement. Alternatively, a pressure activated piston system can be designed to control the position of the actuator. The operator at the surface can pump different flow rate to create different pressure levels through these components to achieve the control of engagement between the actuator and either of the disks.

In a clockwise configuration (421*a*), the engagement disk (431) is controlled by the actuator (436) to couple to the clockwise disk (432) of the clutch. Accordingly, the reversible PDC bit is driven by the clockwise motor (432*a*) and rotates in a clockwise direction.

In a counter-clockwise configuration (421*b*), the engagement disk (431) is controlled by the actuator (436) to couple to the counter-clockwise disk (433) of the clutch. Accordingly, the reversible PDC bit is driven by the counter-clockwise motor (433*a*) and rotates in a counter-clockwise direction.

In the example described above, although the clockwise motor (432*a*) and the mandrel (436) are located on the opposite sides of the clutch while the counter-clockwise motor (433*a*) and the mandrel (436) are located on the same side of the clutch, the locations of the clockwise motor (432*a*) and the counter-clockwise motor (433*a*) may be reversed in other dual mud motor and clutch arrangements.

Figure 4E:
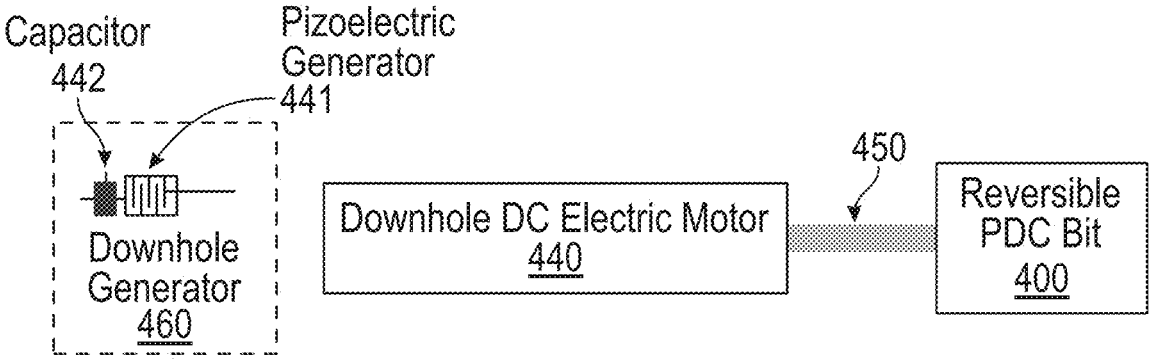

FIG. 4E shows a schematic diagram of an example downhole motor assembly based on a downhole electrical motor. As shown in FIG. 4E, the reversible PDC bit (400) is connected to and driven by a downhole DC electric motor (440) via a drill pipe (450). The electricity may be sent from the surface to operate the downhole DC electric motor (440). The rotation direction of the downhole DC electric motor (440) and the reversible PDC bit (400) is controlled by the polarity of the electricity sent to the downhole DC electric motor from the surface. Alternatively, the downhole DC electric motor (440) may be powered by a downhole generator (460) which is energized by a set of piezoelectric generator (441) and capacitor (442). To change the rotation direction of the downhole DC electric motor (440) and the reversible PDC bit (400), the surface operator changes the polarity of the electricity sent to the downhole DC electric motor (440) from the downhole generator (460).

Embodiments of the invention advantageously reduce the occasions and the time required to change the drill bit, for example due to the low rate of penetration (ROP) or predicted formation change during the drilling operation. Changing the conventional drill bit requires the entire bottom hole assembly (BHA) to be pulled out of the borehole, which is a very time consuming process. With the reversible PDC bits, the service life is significantly extended by having two sets of cutters, and therefore the need for tripping of PDC bits is greatly reduced. In the meantime, the ROP can be significantly increased by using the new cutters on the second sides of blades are used when changes in formation rock characteristics are expected.

What is claimed is:

1. A reversible polycrystalline diamond compact (PDC) bit, comprising:
- at least one blade;
- at least one front cutter disposed on a first side of the at least one blade; and
- at least one rear cutter disposed on a second side of the at least one blade,
- wherein the first side is opposite to the second side along a circumferential direction of the reversible PDC bit,
- wherein rotating the reversible PDC bit in a clockwise direction engages the at least one front cutter to cut into a subterranean formation,
- wherein rotating the reversible PDC bit in a counter-clockwise direction engages the at least one rear cutter to cut into the subterranean formation,
- wherein the reversible PDC bit is coupled to a downhole motor assembly configured to reverse a rotation direction of the reversible PDC bit, the downhole motor assembly comprising:
  - a mud motor; and
  - a sliding sleeve system configured to direct a drilling fluid to selectively flow through the mud motor in one of two opposite directions to change the rotation direction of the reversible PDC bit.

2. The reversible PDC bit of claim 1,
- wherein the at least one front cutter and the at least one rear cutter have different material types or different geometries that are selected according to different rock types in the subterranean formation.

3. A bottom hole assembly (BHA), comprising:
- a reversible polycrystalline diamond compact (PDC) bit, comprising:
  - at least one blade;
  - at least one front cutter disposed on a first side of the at least one blade; and
  - at least one rear cutter disposed on a second side of the at least one blade,
  - wherein the first side is opposite to the second side along a circumferential direction of the reversible PDC bit; and
- a downhole motor assembly coupled to the reversible PDC bit and configured to:
  - rotate the reversible PDC bit; and
  - selectively reverse a rotation direction of the reversible PDC bit, the downhole motor assembly comprising:
  - a mud motor; and a sliding sleeve system configured to direct a drilling fluid to selectively flow through the mud motor in one of two opposite directions to change the rotation direction of the reversible PDC bit, wherein rotating the reversible PDC bit by the downhole motor assembly in a clockwise direction engages the at least one front cutter to cut into a subterranean formation, and wherein rotating the reversible PDC bit by the downhole motor assembly in a counter-clockwise direction engages the at least one rear cutter to cut into the subterranean formation.

4. The BHA of claim 3, wherein the at least one front cutter and the at least one rear cutter have different material types or different geometries that are selected according to different rock types in the subterranean formation.

5. A method to drill a wellbore into a subterranean formation, comprising:

installing a reversible polycrystalline diamond compact (PDC) bit in a drill string of the wellbore, the reversible PDC bit comprising:

at least one blade;

at least one front cutter disposed on a first side of the at least one blade; and at least one rear cutter disposed on a second side of the at least one blade, wherein the first side is opposite to the second side along a circumferential direction of the reversible PDC bit;

rotating the reversible PDC bit in a clockwise direction to engage the at least one front cutter to cut into the subterranean formation; and rotating the reversible PDC bit in a counter-clockwise direction to engage the at least one rear cutter to cut into the subterranean formation selecting, from the clockwise direction and the counter-clockwise direction, a rotation direction of the reversible PDC bit according to a rock type to be cut by the reversible PDC bit, wherein the at least one front cutter and the at least one rear cutter have different material types or different geometries that are selected according to the rock type in the subterranean formation.

6. The method of claim 5, further comprising:

reversing, between the clockwise direction and the counter-clockwise direction, a rotation direction of the reversible PDC bit by adjusting a downhole motor assembly coupled to the reversible PDC bit.

7. The method of claim 6, wherein reversing the rotation direction of the reversible PDC bit comprises:

adjusting a sliding sleeve system to direct a drilling fluid to selectively flow through a mud motor in one of two opposite directions to change the rotation direction of the reversible PDC bit, wherein the downhole motor assembly comprises the mud motor and the sliding sleeve system.

* * * * *